US012529177B2

(12) United States Patent
Djerekarov

(10) Patent No.: US 12,529,177 B2
(45) Date of Patent: Jan. 20, 2026

(54) LAUNDRY TREATMENT APPLIANCE AND METHOD OF PERFORMING A POST-CYCLE CLEANING OPERATION

(71) Applicant: Haier US Appliance Solutions, Inc., Wilmington, DE (US)

(72) Inventor: Jivko Ognianov Djerekarov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 49 days.

(21) Appl. No.: 18/402,213

(22) Filed: Jan. 2, 2024

(65) Prior Publication Data

US 2025/0215629 A1 Jul. 3, 2025

(51) Int. Cl.

| | |
|---|---|
| ***D06F 34/18*** | (2020.01) |
| ***D06F 25/00*** | (2006.01) |
| *D06F 105/02* | (2020.01) |
| *D06F 105/48* | (2020.01) |

(52) U.S. Cl.

CPC ..... *D06F 34/18* (2020.02); *D06F 25/00* (2013.01); *D06F 2105/02* (2020.02); *D06F 2105/48* (2020.02)

(58) Field of Classification Search

CPC ..... D06F 34/18

See application file for complete search history.

(56) References Cited

U.S. PATENT DOCUMENTS

2014/0290313 A1* 10/2014 Kulkarni ..... D06F 25/00 68/19.2

FOREIGN PATENT DOCUMENTS

| | | | |
|---|---|---|---|
| EP | 1860226 | B1 | 12/2009 |
| JP | 2018086463 | A | 6/2018 |
| WO | WO2011054761 | A1 | 5/2011 |
| WO | WO2019137210 | A1 | 6/2018 |

* cited by examiner

*Primary Examiner* — Jason Y Ko

(74) *Attorney, Agent, or Firm* — Dority & Manning, P.A.

(57) ABSTRACT

A laundry treatment appliance includes a cabinet; a laundry assembly positioned within the cabinet, the laundry assembly including a wash tub and a drum rotatably provided within the wash tub; and a controller operably coupled with the drum, the controller configured to perform an operation. The operation includes determining that a predetermined laundry cycle of a laundry load has been completed; determining that the laundry load has been removed from the laundry assembly after determining that the predetermined laundry cycle has been completed; and initiating a rinse sequence after determining that the laundry load has been removed from the drum, wherein the rinse sequence is configured to remove contaminants from the laundry assembly.

20 Claims, 4 Drawing Sheets

LAUNDRY TREATMENT APPLIANCE AND METHOD OF PERFORMING A POST-CYCLE CLEANING OPERATION

FIELD OF THE INVENTION

The present subject matter relates generally to home appliances, and more particularly to laundry treatment appliances.

BACKGROUND OF THE INVENTION

Laundry treatment appliances may perform one or more laundry operations, such as washing and/or drying. As such, laundry treatment appliances generally include a cabinet with a drum rotatably mounted therein. During operation, a motor rotates the drum, e.g., to tumble articles located within a chamber defined by the drum. Laundry appliances capable of performing a drying operation also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance. Dryer appliances may further include filter systems for removing foreign materials, such as lint, from passing into the exhaust conduit, which can impair dryer performance and may present a fire hazard due to the potential for combustion.

Laundry treatment appliances generally wash a wide variety of laundry loads, including heavily soiled clothing, garments, sportswear, and the like. Such soiled loads may occasionally leave behind particles or residue within the machine, such as in the drum or tub. For one example, excessive pet hair may remain within the drum after completing a wash cycle of clothing containing large quantities of pet hair. The remaining residue may then be incorporated into subsequent wash cycles, resulting in less effective washing and contamination of the subsequent laundry loads.

Accordingly, a laundry treatment appliance which obviates one or more of the above-mentioned drawbacks would be beneficial. In particular, a laundry treatment appliance including one or more features for fully rinsing a wash tub and wash drum after a heavily soiled laundry load would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet; a laundry assembly positioned within the cabinet, the laundry assembly including a wash tub and a drum rotatably provided within the wash tub; and a controller operably coupled with the drum, the controller configured to perform an operation. The operation may include determining that a predetermined laundry cycle of a laundry load has been completed; determining that the laundry load has been removed from the laundry assembly after determining that the predetermined laundry cycle has been completed; and initiating a rinse sequence after determining that the laundry load has been removed from the drum, wherein the rinse sequence is configured to remove contaminants from the laundry assembly.

In another exemplary aspect of the present disclosure, a method of operating a laundry treatment appliance is provided. The laundry treatment appliance may include a laundry assembly including a tub and a drum. The method may include determining that a predetermined laundry cycle of a laundry load has been completed; determining that the laundry load has been removed from the laundry assembly after determining that the predetermined laundry cycle has been completed; and initiating a rinse sequence after determining that the laundry load has been removed from the drum, wherein the rinse sequence is configured to remove contaminants from the laundry assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
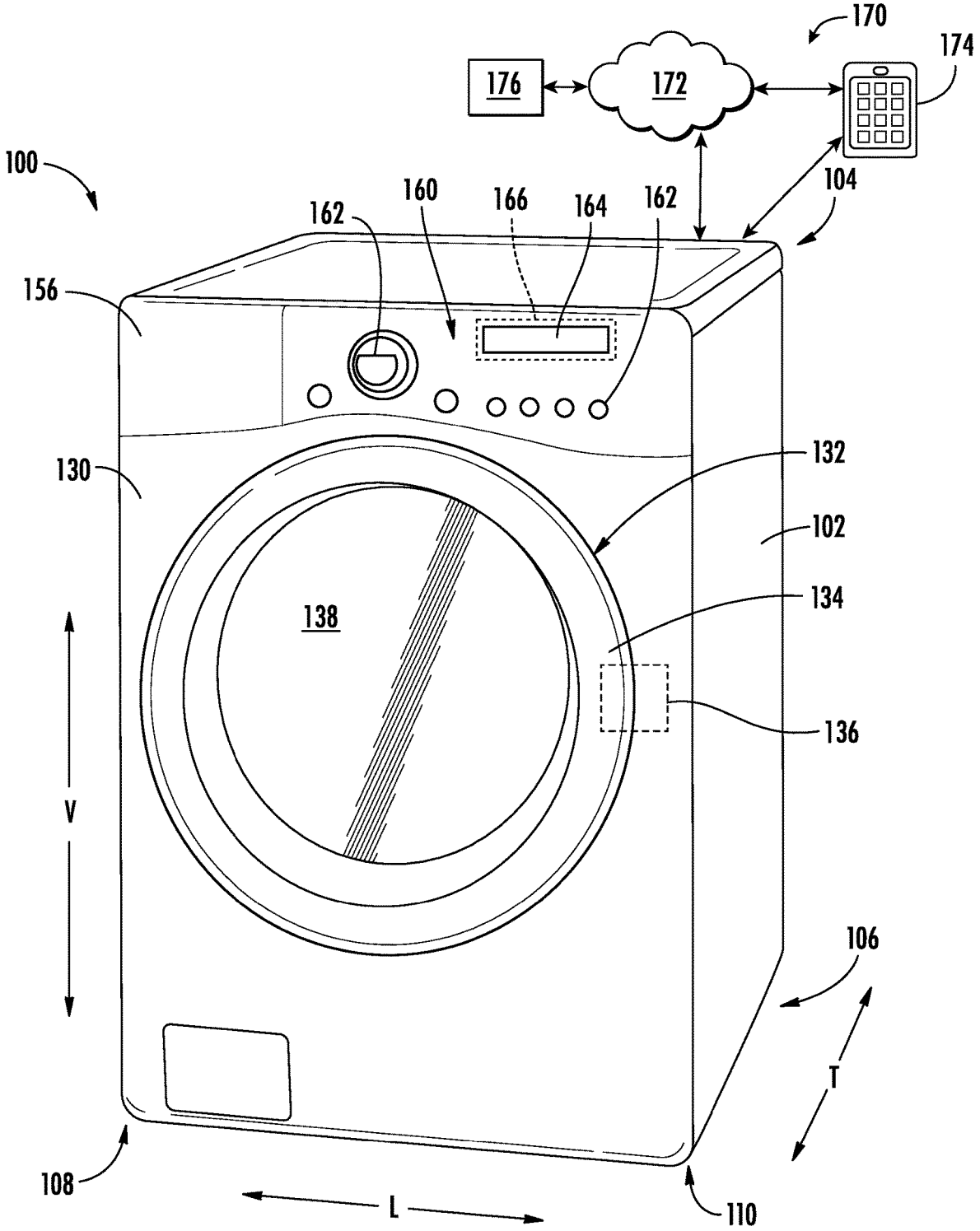
FIG. 1 provides a perspective view of a laundry appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
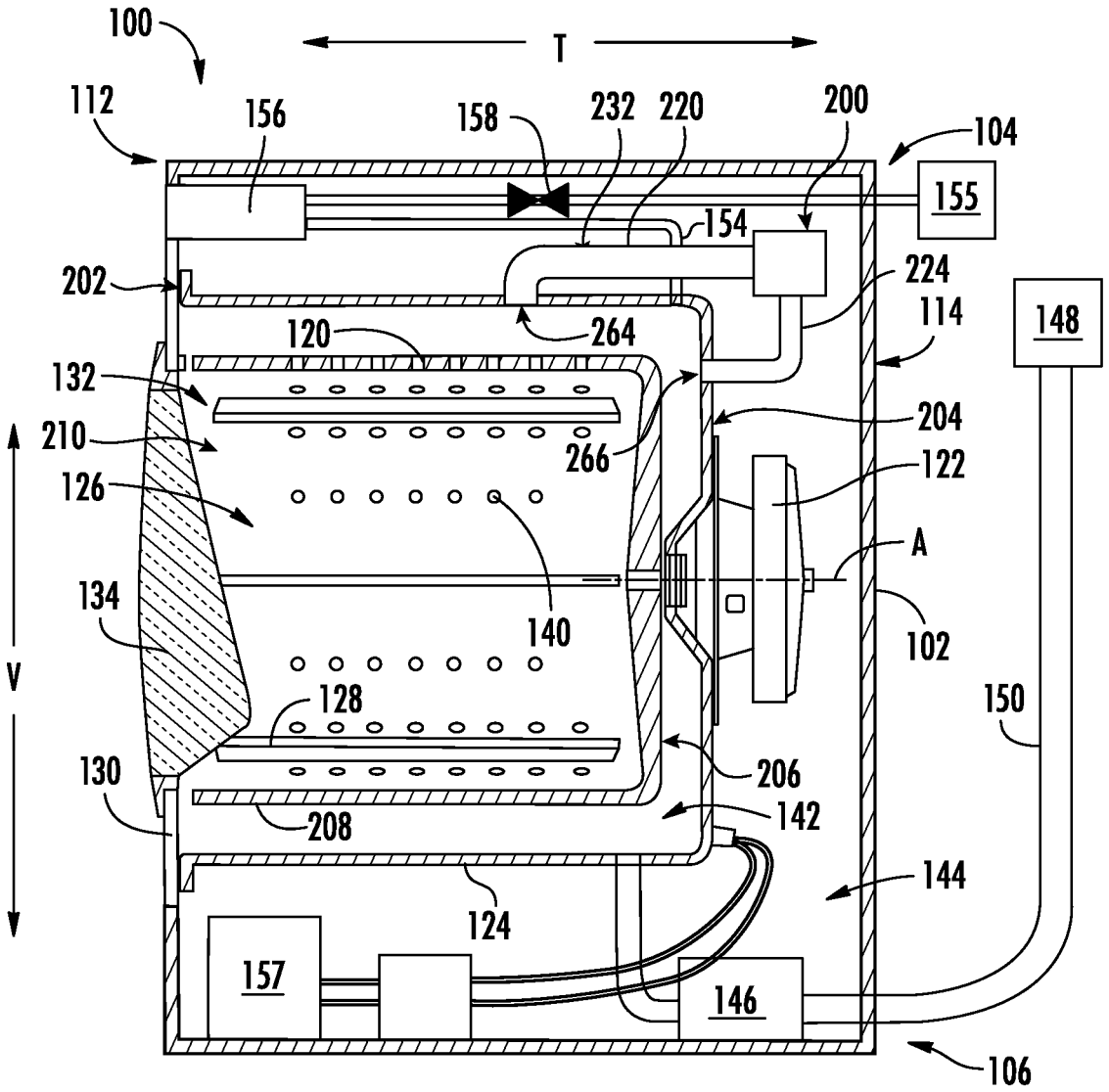
FIG. 2 provides a side sectional view of the exemplary laundry appliance of FIG. 1.

Referring now to the figures, an exemplary laundry appliance that may be used to implement aspects of the present subject matter will be described. Specifically, FIG. 1 is a perspective view of an exemplary horizontal axis washer/dryer appliance 100 (e.g., washer and condenser dryer combination appliance), referred to herein for simplicity as laundry appliance 100. FIG. 2 is a side sectional view of laundry appliance 100. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a drum (or laundry basket) 120 is rotatably mounted within cabinet 102 such that it is rotatable about an axis of rotation A. According to the illustrated embodiment, axis of rotation A is substantially parallel to a horizontal direction (e.g., the transverse direction T), as this exemplary appliance is a front load appliance. A motor 122, such as a pancake motor, is in mechanical communication with drum 120 to selectively rotate drum 120 (e.g., during an agitation or a rinse phase of laundry appliance 100). Motor 122 may be mechanically coupled to drum 120 directly or indirectly (e.g., via a pulley and a belt—not pictured). Drum 120 may be received within a tub 124 that defines a chamber 126 that is configured for receipt of articles for washing or drying. Collectively, tub 124 and drum 120 may be referred to as a laundry assembly.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together or dried together in laundry appliance 100 (e.g., the combination washer and condenser dryer) and may include a mixture of different or similar articles of clothing of different or similar types and kinds of fabrics, textiles, garments and linens within a particular laundering process.

Tub 124 may hold wash and rinse fluids for agitation in drum 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Drum 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from drum 120 into chamber 126. In this manner, for example, ribs 128 may lift articles disposed in drum 120 and then allow such articles to tumble back to a bottom of drum 120 as it rotates. Ribs 128 may be mounted to drum 120 such that ribs 128 rotate with drum 120 during operation of laundry appliance 100.

Referring generally to FIGS. 1 and 2, cabinet 102 may include a front panel 130 which defines an opening 132 that permits user access to drum 120 and tub 124. More specifically, laundry appliance 100 includes a door 134 that is positioned over opening 132 and is rotatably mounted to front panel 130. In this manner, door 134 permits selective access to opening 132 by being movable between an open position (not shown) facilitating access to tub 124 and a closed position (FIG. 1) prohibiting access to tub 124. Laundry appliance 100 may further include a latch assembly 136 (see FIG. 1) that is mounted to cabinet 102 or door 134 for selectively locking door 134 in the closed position or detecting the door 134 in the closed position. Latch assembly 136 may be desirable, for example, to ensure only secured access to chamber 126 or to otherwise ensure and verify that door 134 is closed during certain operating cycles or events.

In some embodiments, a window 138 in door 134 permits viewing of drum 120 when door 134 is in the closed position (e.g., during operation of laundry appliance 100). Door 134 may include a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, drum 120 may also define a plurality of perforations 140 in order to facilitate fluid communication between an interior of drum 120 and tub 124. A sump 142 is defined by tub 124 at a bottom of tub 124 along the vertical direction V. Thus, sump 142 is configured for receipt of and generally collects wash fluid during operation of laundry appliance 100. For example, during operation of laundry appliance 100, wash fluid (and/or contaminants or debris) may be urged by gravity from drum 120 to sump 142 through plurality of perforations 140.

In some embodiments, a drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle or phase (e.g., as a portion of a wash cycle), drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, pump assembly 144 may direct wash fluid disposed in sump 142 to spout 154 in order to circulate wash fluid in tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

A water supply valve or control valve 158 may provide a flow of water from a water supply source (such as a municipal water supply 155) into detergent dispenser 156 or into tub 124. In this manner, control valve 158 may generally be operable to supply water into detergent dispenser 156 to generate a wash fluid (e.g., for use in a wash cycle) or a flow of fresh water (e.g., for a rinse phase). It should be appreciated that control valve 158 may be positioned at any other suitable location within cabinet 102.

A control panel 160 including a plurality of input selectors 162 (e.g., buttons, knobs, toggles, touch screens, etc.) is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of laundry appliance 100 is controlled by a controller or processing device 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry-such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into drum 120 through opening 132, and a washing or wash/dry operation (e.g., having discrete wash and dry cycles) is initiated through operator manipulation of input selectors 162. Tub 124 is filled with water, detergent, or other fluid additives (e.g., via spout 154 and or detergent drawer 156). One or more valves (e.g., control valve 158) can be controlled by laundry appliance 100 to provide for filling drum 120 to the appropriate level for the amount of articles being washed or rinsed. By way of example for a wash cycle, once drum 120 is properly filled with fluid, the contents of drum 120 can be agitated (e.g., with ribs 128) for washing of articles in drum 120.

After an agitation phase of the wash cycle is completed, tub 124 can be drained. Laundry articles can then be rinsed by again adding fluid to tub 124, depending on the particulars of the cleaning cycle selected by a user. Ribs 128 may again provide agitation within drum 120. One or more spin cycles or phases may also be used. In particular, a spin phase may be applied after the wash cycle or after the rinse phase in order to wring wash fluid from the articles being washed. During a final spin cycle, drum 120 is rotated at relatively high speeds and drain pump assembly 144 may discharge wash fluid from sump 142. Following the wash cycle, a dry cycle may be executed or operation a user may selectively remove the articles from drum 120 (e.g., by opening door 134 and reaching into drum 120 through opening 132), as will be described in greater detail below.

While described in the context of a specific embodiment of horizontal axis laundry appliance 100, using the teachings disclosed herein it will be understood that horizontal axis laundry appliance 100 is provided by way of example only. Other laundry appliances having different configurations, different appearances, or different features may also be utilized with the present subject matter as well (e.g., vertical axis laundry appliances). Indeed, it should be appreciated that aspects of the present subject matter may further apply to other laundry appliances. In this regard, the same methods as systems and methods as described herein may be used to implement travel cycles for other appliances, as described in more detail below.

Referring still to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate with external devices either directly or through a network 172. For example, a consumer may use a consumer device 174 to communicate directly with laundry appliance 100. For example, consumer devices 174 may be in direct or indirect communication with laundry appliance 100, such directly through a local area network (LAN), Wi-Fi, Bluetooth, Zigbee, etc. or indirectly through network 172. In general, consumer device 174 may include its own user interface and be any suitable device for providing or receiving communications or commands from a user. In this regard, consumer device 174 may include, for example, a personal phone, a tablet, a laptop computer, or another mobile device.

In addition, a remote server 176 may be in communication with laundry appliance 100 or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), or protection schemes (e.g. VPN, secure HTTP, SSL).

In general, network 172 can be any type of communication network. For example, network 172 can include one or more of a wireless network, a wired network, a personal area network, a local area network, a wide area network, the internet, a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
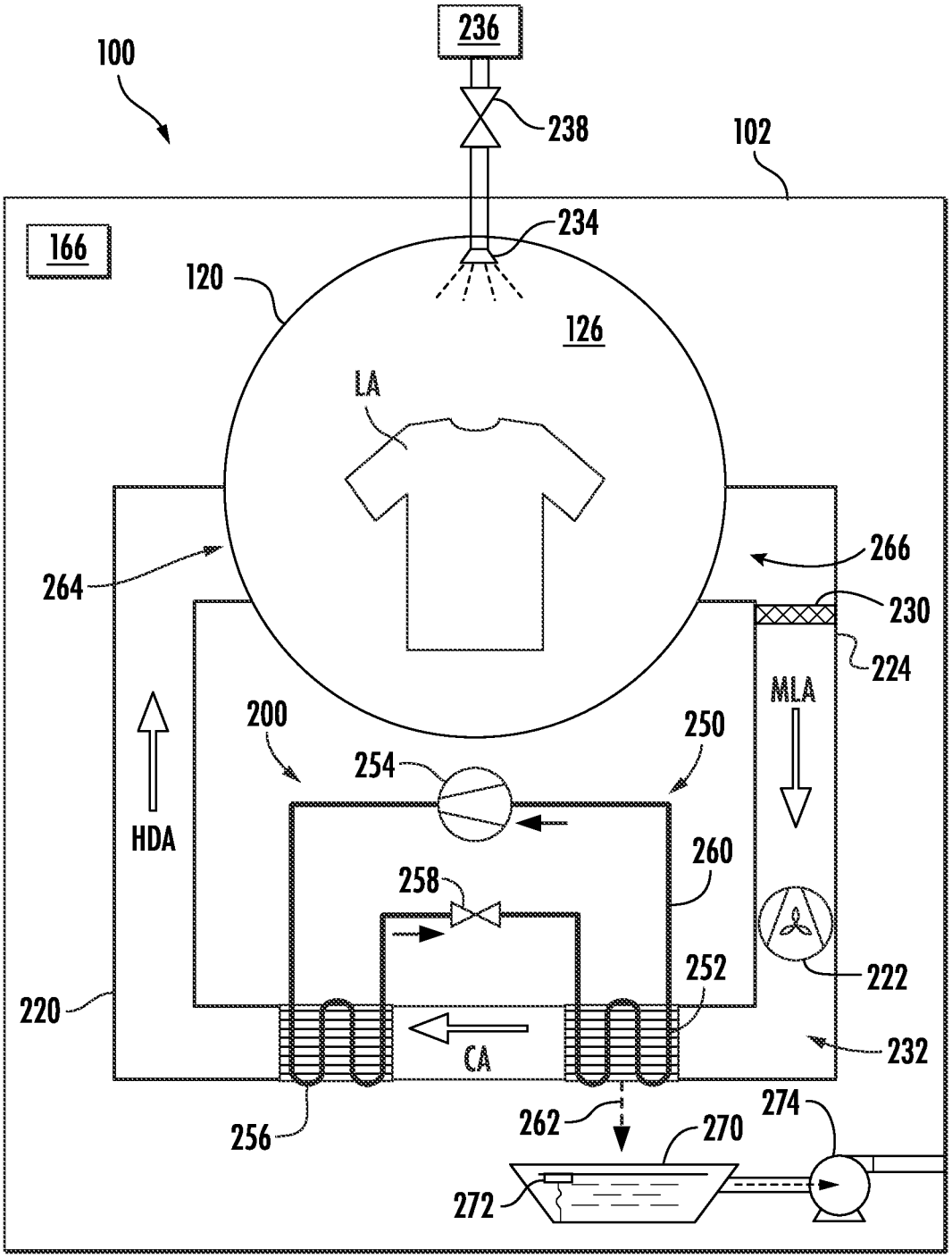
FIG. 3 provides a schematic diagram of an exemplary heat pump dryer appliance and a conditioning system thereof in accordance with exemplary embodiments of the present disclosure.
Figure 4:
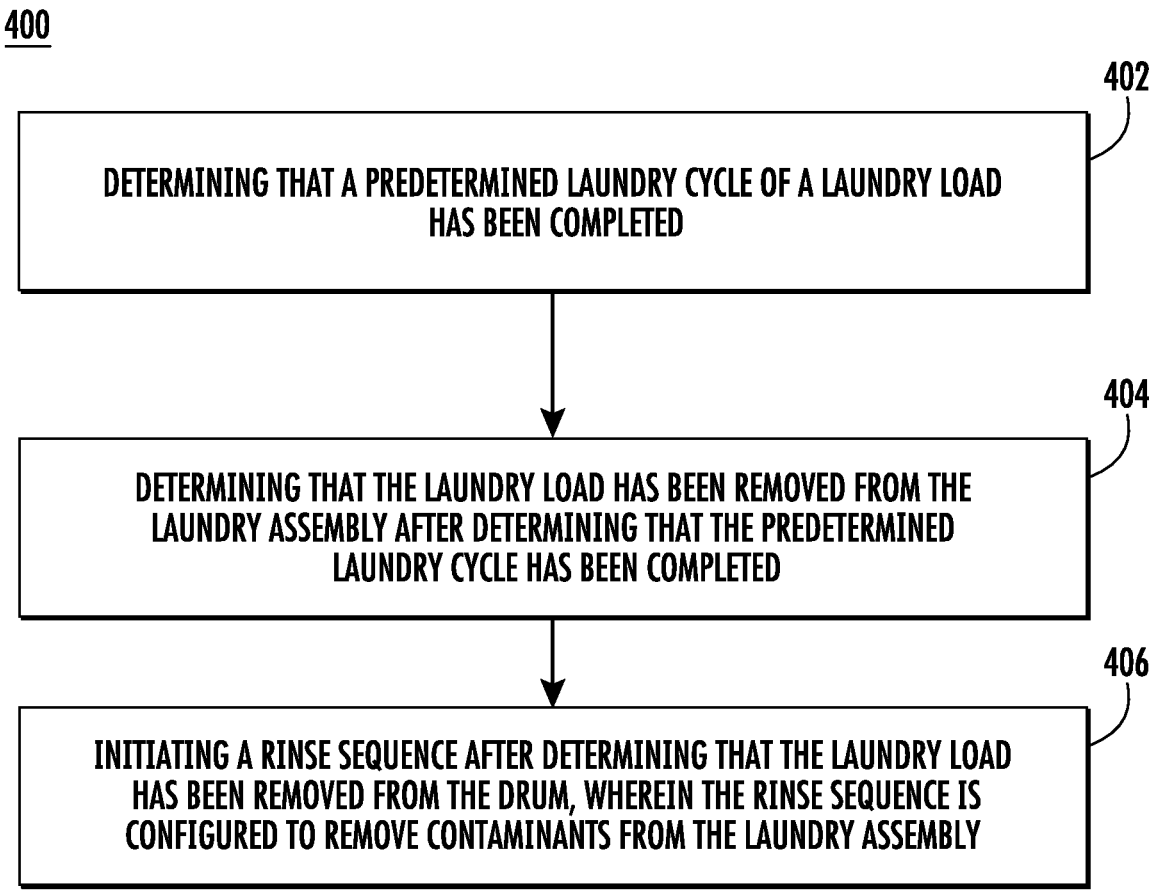
FIG. 4 illustrates a method for operating a laundry appliance in accordance with exemplary embodiments of the present disclosure.

Referring now specifically to FIGS. 2 and 3, a heater included with or provided as a heat pump system, a condenser system, a refrigerant-based air conditioning system, or another suitable conditioning system 200 for facilitating a drying process or dry cycle within laundry appliance 100 will be described in more detail. As illustrated, conditioning system 200 may be mounted to tub 124 such that it is fluidly coupled to chamber 126. More specifically, as illustrated, tub 124 extends between a front portion 202 and a back portion 204 (e.g., along the transverse direction T). Drum 120 may also include a back or rear wall 206 (e.g., at back portion of drum 120 or proximate back portion 204 of tub 124). Rear wall 206 of drum 120 may be rotatably supported within cabinet 102 by a suitable bearing or may be fixed or rotatable.

In some embodiments, drum 120 is generally cylindrical in shape. For instance, drum 120 may have an outer cylindrical wall 208 and a front flange or wall that defines an opening 210 of drum 120 (e.g., at front portion 202 of laundry basket 120). As shown, opening 210 generally coincides with opening 132 of front panel 112 of cabinet 102 (e.g., to provide user access to chamber 126 for loading and unloading of articles into and out of chamber 126 of drum 120).

Conditioning system 200 may include a return duct 220 that is mounted to tub 124 for circulating air within chamber 126 to facilitate a dry cycle. For example, according to the illustrated exemplary embodiments, return duct 220 is fluid coupled to tub 124 proximate a top of tub 124. Return duct 220 receives heated air that has been heated or dehumidified by a conditioning system 200 and provides the heated air to drum 120 via one or more holes defined by rear wall 206 or cylindrical wall 208 of drum 120 (e.g., such as perforations 140).

Specifically, moisture laden, heated air is drawn from drum 120 by an air handler, such as a blower fan 222, which may generate a negative air pressure within drum 120. As the air passes from blower fan 222, it enters an intake duct 224 and then is passed into conditioning system 200. In some embodiments, the conditioning system 200 may have a heater that includes or is provided as an electric heating element (e.g., a resistive heating element) or a gas-powered heating element (e.g., a gas burner), as would be understood. According to the illustrated exemplary embodiment, laundry appliance 100 is a heat pump dryer appliance and thus conditioning system 200 may be or include a heater including a heat pump having a sealed refrigerant circuit, as described in more detail below with reference to FIG. 3. Heated air (with a lower moisture content than was received from drum 120), exits conditioning system 200 and returns to drum 120 by a return duct 220. After the clothing articles have been dried, they may be removed from the drum 120 via opening 132.

As shown, laundry appliance 100 may further include one or more lint filters 230 (FIG. 3) to collect lint during drying operations. The moisture laden heated air passes through intake duct 224 enclosing screen filter 230, which traps lint particles. More specifically, filter 230 may be placed into an air flow path 232 defined by drum 120, conditioning system 200, intake duct 224, and return duct 220. Filter 230 may be positioned in the process air flow path 232 and may include a screen, mesh, other material to capture lint in the air flow 232. The location of lint filters in laundry appliance 100 as shown in FIG. 3 is provided by way of example only, and other locations may be used as well. According to exemplary embodiments, lint filter 230 is readily accessible by a user of the appliance. As such, lint filter 230 should be manually cleaned by removal of the filter, pulling or wiping away accumulated lint, and then replacing the filter 230 for subsequent drying or dry cycles.

According to optional embodiments, laundry appliance 100 may facilitate a steam dry process. In this regard, laundry appliance 100 may offer a steam dry cycle, during which steam is injected into chamber 126 (e.g., to function similar to a traditional garment steamer to help remove wrinkles, static, etc.). Accordingly, as shown for example in FIG. 3, laundry appliance 100 may include a misting nozzle 234 that is in fluid communication with a water supply 236 (e.g., such as water supply 155) in order to direct mist into chamber 126. Laundry appliance 100 may further include a water supply valve or control valve 238 for selecting discharging the flow of mist into chamber 126. It should be appreciated that control valve 238 may be positioned at any other suitable location within cabinet 102.

FIG. 3 provides a schematic view of laundry appliance 100 and depicts conditioning system 200 in more detail. In the illustrated embodiments, laundry appliance 100 is a heat pump dryer appliance and thus conditioning system 200 includes a sealed system 250. Sealed system 250 includes various operational components, which can be encased or located within a machinery compartment of laundry appliance 100. Generally, the operational components are operable to execute a vapor compression cycle for heating process air passing through conditioning system 200. The operational components of sealed system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components (e.g., at least one additional evaporator, compressor, expansion device, or condenser). For instance, sealed system 250 may include two evaporators.

In performing a dry cycle, one or more laundry articles LA may be placed within chamber 126 of drum 120. For instance, following a wash cycle, articles may remain within chamber 126. Hot dry air HDA may be supplied to chamber 126 via return duct 220. The hot dry air HDA enters chamber 126 of drum 120 via a tub inlet 264 defined by drum 120 (e.g., the plurality of holes defined in rear wall 206 or cylindrical wall 208 of drum 120 as shown in FIG. 2). The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through a tub outlet 266 defined by drum 120 and flows into intake duct 224.

After exiting chamber 126 of drum 120, the warm moisture laden air MLA flows downstream to conditioning system 200. Blower fan 222 moves the warm moisture laden air MLA, as well as the air more generally, through a process air flow path 232 defined by drum 120, conditioning system 200, intake duct 224, and return duct 220. Thus, generally, blower fan 222 is operable to move air through or along the process air flow path 232. The duct system includes all ducts that provide fluid communication (e.g., airflow communication) between tub outlet 266 and conditioning system 200 and between conditioning system 200 and tub inlet 264. Although blower fan 222 is shown positioned between drum 120 and conditioning system 200 along intake duct 224, it will be appreciated that blower fan 222 can be positioned in other suitable positions or locations along the duct system.

As further depicted in FIG. 3, the warm moisture laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA—thereby reducing its temperature. As a result, moisture in the air is condensed and such condensate water may be drained from conditioning system 200 (e.g., using a drain line 262, which is also depicted in FIG. 3).

In optional embodiments, a condenser tank or a condensate collection tank 270 is in fluid communication with conditioning system 200 (e.g., via drain line 262). Collection tank 270 is operable to receive condensate water from the process air flowing through conditioning system 200, and more particularly, condensate water from evaporator 252. A sensor 272 operable to detect when water within collection tank 270 has reached a predetermined level. Sensor 272 can be any suitable type of sensor, such as a float switch as shown in FIG. 3. Sensor 272 can be communicatively coupled with controller 166 (e.g., via a suitable wired or wireless communication link). A drain pump 274 is in fluid communication with collection tank 270. Drain pump 274 is operable to remove a volume of water from collection tank 270 and, for example, discharge the collected condensate to an external drain. In some embodiments, drain pump 274 can remove a known or predetermined volume of water from collection tank 270. Drain pump 274 can remove the condensate water from collection tank 270 and can move or drain the condensate water downstream (e.g., to a gray water collection system). Particularly, in some embodiments, controller 166 is configured to receive, from sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Air passing over evaporator 252 becomes cooler than when it exited drum 120 at tub outlet 266. As shown in FIG. 3, cool air CA (cool relative to hot dry air HDA and moisture laden air MLA) flowing downstream of evaporator 252 is subsequently caused to flow across condenser 256 (e.g., across coils or tubing thereof), which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing warm dry air HDA for resupply to drum 120 of laundry appliance 100. The warm dry air HDA passes over and around laundry articles LA within the chamber 126 of drum 120, such that warm moisture laden air MLA is generated, as mentioned above.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the air for supply to chamber 126 of drum 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of drum 120. The process is repeated as air is circulated along process air flow path 232 while the refrigerant is cycled through sealed system 250, as described above.

In the case of a tumble cycle, the heater (e.g., sealed system 250) remains inactive such that heat is not actively generated or, alternatively, the heater may be directed to a relatively low heat setting (i.e., a first heat setting that is lower in power, voltage, duty cycle, or temperature than a second heat setting of the dry cycle). For instance, the compressor 254 may be directed to a reduced state. Optionally, compressor 254 may be held inactive to restrict the flow of refrigerant through sealed system 250. Nonetheless, air may be cycled through chamber 126 along the same path as air circulated during a dry cycle (e.g., as described above).

Although laundry appliance 100 is depicted and described herein as a heat pump dryer appliance, the inventive aspects of the present disclosure can apply to other types of closed loop airflow circuit dryer appliances. For instance, in other embodiments, laundry appliance 100 can utilizes an air-to-air heat exchanger instead of evaporator 252 or an electric or gas heating element may be provided instead of condenser 256. Thus, in such embodiments, the working fluid that interacts thermally with the process air may be air. Further, in some embodiments, laundry appliance 100 can be a combination washer/dryer appliance having a closed loop airflow circuit along which process air may flow for drying operations.

Now that the construction of laundry appliance 100 and the configuration of controller 166 according to exemplary embodiments have been presented, an exemplary method 400 of operating a laundry appliance will be described. Although the discussion below refers to the exemplary method 400 of operating laundry appliance 100, one skilled in the art will appreciate that the exemplary method 400 is applicable to the operation of a variety of other laundry appliances. In exemplary embodiments, the various method steps as disclosed herein may be performed by controller 166 (e.g., as a wash/dry operation) or a separate, dedicated controller.

At step 402, method 400 may include determining that a predetermined laundry cycle of a laundry load has been completed. In detail, the laundry treatment appliance (e.g., laundry treatment appliance 100) may perform one or more laundry operations or cycles. The one or more operations or cycles may include wash or washing cycles, drying cycles, rinse cycles, spin cycles, sanitizing cycles, soak cycles, or the like. For instance, continuing with the embodiment above in which the appliance is a combination washing machine and dryer, the predetermined laundry cycle includes each of a wash cycle and a drying cycle.

The completion of the predetermined laundry cycle may be indicated by a final drain phase. For instance, the controller may determine that the predetermined laundry cycle is complete after the final drain phase is completed and no water is left in the drum. Additionally or alternatively, the predetermined laundry cycle may be complete upon the completion of a final spin phase. One or more signals may thus be received indicating the completion of the predetermined laundry cycle (or cycles).

At step 404, method 400 may include determining that the laundry load has been removed from the laundry assembly after the completion of the predetermined laundry cycle. For instance, the appliance may include one or more sensors, instruments, devices, or the like to determine whether the laundry load has been removed from the laundry assembly (e.g., the drum). For instance, a door sensor to determine an open or closed position of the door may be incorporated, a weight sensor within the laundry assembly may be incorporated (e.g., to sense a weight of the laundry load within the drum), a camera configured to capture one or more images of the laundry assembly may be incorporated, etc. Additionally or alternatively, the appliance may be connected with a remote device (e.g., through network 172). Thus, a user may input a signal to the appliance signifying that the laundry load has been removed from the laundry assembly.

At step 406, method 400 may include initiating a rinse sequence after determining that the laundry load has been removed from the drum. The rinse sequence may be configured to remove contaminants from the laundry assembly (e.g., the drum and the tub) after the completion of a laundry operation (e.g., a wash operation, a drying operation, both a wash and a drying operation, etc.). For instance, upon the completion of a wash operation of a particularly heavily soiled laundry load, the rinse sequence may be initiated. The rinse sequence may be initiated automatically or manually (e.g., by an input from a user). As will be discussed, the rinse sequence may include one or multiple steps or phases.

According to some embodiments, initiating the rinse sequence may include directing a rotation of the drum at a first predetermined rotational speed (e.g., a spin phase). In detail, upon determining that the laundry assembly (e.g., drum) is empty (e.g., the laundry load has been removed), the rinse sequence may direct the drum to rotate (e.g., via a motor). At this point, the laundry assembly may be empty such that the laundry load has been removed and water from the wash operation has been drained.

The first predetermined rotational speed may be a relatively high speed. For instance, the first predetermined rotational speed may be greater than about 500 rotations per minute (RPM). In some instances, the first predetermined rotational speed is between about 600 and about 1000 RPM. The first predetermined rotational speed may vary according to specific embodiments, however, and the disclosure is not limited to the examples provided herein.

Further, at step 406, the drum may be rotated (e.g., at the first predetermined rotational speed) for a predetermined length of time. The predetermined length of time may be a first predetermined length of time. In some instances, the predetermined length of time is between about 2 minutes and about 5 minutes. However, the predetermined length of time may vary according to specific embodiments. According to some embodiments, the predetermined length of time may be in excess of 10 or more minutes. After the predetermined length of time elapses, method 400 may stop the rotation of the drum. Advantageously, debris such as pet hair, lint, and other contaminants may be forced from the drum to the tub (e.g., via perforations 140).

According to some embodiments, initiating the rinse sequence may include directing an air handler at a predetermined fan speed (e.g., a fan phase). The predetermined fan speed may be selected by the user, may be programmed into the appliance, or may be determined upon an initiation of the rinse sequence according to one or more variables (e.g., load size, time since last rinse sequence, etc.). In detail, as discussed above, the appliance may be a combination washing machine and dryer appliance capable of performing each of a wash operation and a drying operation. Thus, an air circulation system may be included. The air circulation system may include a duct (e.g., duct 220), an air handler (e.g., fan 222), and a filter (e.g., filter 230). At step 406, method 400 may include driving or directing the air handler to force air through the laundry system. As the duct is in fluid communication with the laundry system, the air flow may drive the contaminants and debris toward the filter. Accordingly, the filter may collect the contaminants and debris. In some embodiments, the user may then manually remove and clean the filter. In additional or alternative embodiments, the filter may be automatically cleaned within the appliance.

According to some embodiments, initiating the rinse sequence may include supplying a predetermined amount of water to the laundry system (e.g., a water supply phase). For instance, at step 406, method 400 may include activating the water supply to add the predetermined amount of water to the laundry system. The predetermined amount of water may be between about 1 gallon and about 5 gallons. However, the amount of water supplied to the laundry system may vary according to specific embodiments, and the disclosure it not limited to the examples provided herein.

After supplying the predetermined amount of water to the laundry system, method 400 may include rotating the drum at a second predetermined rotational speed. The second predetermined rotational speed may be less than the first predetermined rotational speed. For instance, the second predetermined rotational speed may be between about 50 RPM and about 200 RPM. In some embodiments, the drum may be rotated in alternating directions (e.g., oscillated). As such, a sloshing action may be generated within the water supplied to the laundry system.

As mentioned above, the rinse sequence may include any one or any combination of the phases mentioned above. For instance, in a stand-alone washing machine, the rinse sequence may include the spin phase and the water supply phase. The water supply phase may be performed after the spin phase. For a combination appliance, each of the spin phase, the fan phase, and the water supply phase may be applied. In some iterations, only the spin phase is applied. Accordingly, the rinse sequence may include any suitable arrangement of phases. Additionally or alternatively, the rinse sequence may repeat one or more of the phases (e.g., two spin phases, two water supply phases, etc.).

As mentioned above, the rinse sequence may be performed automatically. For example, a user may select a particular wash operation to be performed, such as a pet care operation including heavily soiled laundry articles with pet hair. Upon the completion of the laundry operation (e.g., the pet care wash operation and an optional drying operation) and after the laundry load is removed from the laundry assembly, the appliance may automatically initiate the rinse sequence.

In some instances, method 400 may recommend performing the rinse sequence. For instance, after the completion of a wash operation (or a plurality of wash operations), a prompt may be displayed to the user (e.g., via the on board display or via a connected remote device). The prompt may allow the user to manually initiate the rinse sequence. Advantageously, the laundry assembly may be fully and properly cleaned after a heavy soil laundry operation and contaminants are not carried over into subsequent operations.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance comprising:
- a cabinet;
- a laundry assembly positioned within the cabinet, the laundry assembly comprising:
  - a wash tub;
  - a drum rotatably provided within the wash tub; and
  - a filter provided outside the wash tub; and
- a controller operably coupled with the drum, the controller configured to perform an operation, the operation comprising:
  - determining that a predetermined laundry cycle of a laundry load has been completed;
  - determining that the laundry load has been removed from the laundry assembly after determining that the predetermined laundry cycle has been completed; and
  - initiating a rinse sequence after determining that the laundry load has been removed from the drum, wherein the rinse sequence is configured to remove contaminants from the drum to the wash tub to the filter.

2. The laundry treatment appliance of claim 1, wherein initiating the rinse sequence comprises:
- directing a rotation of the drum at a first predetermined rotational speed; and
- stopping the rotation of the drum after a predetermined length of time.

3. The laundry treatment appliance of claim 2, wherein the first predetermined rotational speed is greater than 600 rotations per minute (RPM).

4. The laundry treatment appliance of claim 2, further comprising an air circulation system, the air circulation system comprising:
- a duct in fluid communication with the laundry assembly, wherein
- the filter positioned within the duct; and
- an air handler configured to urge air through the duct toward the filter.

5. The laundry treatment appliance of claim 4, wherein initiating the rinse sequence further comprises:
- directing the air handler at a predetermined fan speed to force air through the laundry system to collect particles from the laundry system at the filter.

6. The laundry treatment appliance of claim 2, further comprising a water supply.

7. The laundry treatment appliance of claim 6, wherein initiating the rinse sequence further comprises:

supplying, via the water supply, a predetermined amount of water to the laundry system; and rotating the drum at a second predetermined rotational speed after supplying the predetermined amount of water to the laundry system.

8. The laundry treatment appliance of claim 7, wherein the second predetermined rotational speed is less than the first predetermined rotational speed.

9. The laundry treatment appliance of claim 7, wherein the supplying the predetermined amount of water to the laundry system is performed after rotating the drum at the first predetermined rotational speed.

10. The laundry treatment appliance of claim 1, wherein the laundry treatment appliance is a combination laundry machine configured to perform each of a washing operation and a drying operation.

11. A method of operating a laundry treatment appliance, the laundry treatment appliance comprising a laundry assembly comprising a tub, a drum, and an air circulation system, the air circulation system comprising a duct in fluid communication with the laundry assembly, a filter positioned within the duct, and an air handler configured to urge air through the duct toward the filter, the method comprising:

determining that a predetermined laundry cycle of a laundry load has been completed;

determining that the laundry load has been removed from the laundry assembly after determining that the predetermined laundry cycle has been completed; and initiating a rinse sequence after determining that the laundry load has been removed from the drum, wherein the rinse sequence is configured to remove contaminants from the laundry assembly, wherein initiating the rinse sequence comprises:

directing a rotation of the drum at a first predetermined rotational speed;

stopping the rotation of the drum after a predetermined length of time; and directing the air handler at a predetermined fan speed to force air through the laundry system to collect particles from the laundry system at the filter.

12. The method of claim 11, wherein the first predetermined rotational speed is greater than 600 rotations per minute (RPM).

13. The method of claim 11, wherein the laundry treatment appliance further comprises a water supply.

14. The method of claim 13, wherein initiating the rinse sequence further comprises:

supplying, via the water supply, a predetermined amount of water to the laundry system; and rotating the drum at a second predetermined rotational speed after supplying the predetermined amount of water to the laundry system.

15. The method of claim 14, wherein the second predetermined rotational speed is less than the first predetermined rotational speed.

16. The method of claim 14, wherein the supplying the predetermined amount of water to the laundry system is performed after rotating the drum at the first predetermined rotational speed.

17. The method of claim 11, wherein the laundry treatment appliance is a combination laundry machine configured to perform each of a washing operation and a drying operation.

18. A laundry treatment appliance comprising:

a cabinet;

a laundry assembly positioned within the cabinet, the laundry assembly comprising:

a wash tub;

a drum rotatably provided within the wash tub;

a duct in fluid communication with the wash tub;

a filter positioned within the duct; and a fan configured to urge air through the duct toward the filter; and a controller operably coupled with the drum, the controller configured to perform an operation, the operation comprising:

determining that a predetermined laundry cycle of a laundry load has been completed;

determining that the laundry load has been removed from the laundry assembly after determining that the predetermined laundry cycle has been completed; and initiating a rinse sequence after determining that the laundry load has been removed from the drum, wherein the rinse sequence is configured to remove contaminants from the laundry assembly, and wherein the rinse sequence comprises directing the fan at a predetermined fan speed to force air through the laundry system to collect particles from the laundry system at the filter.

19. The laundry treatment appliance of claim 1, wherein the predetermined fan speed is based on a time since a last rinse sequence.

20. The laundry treatment appliance of claim 1, wherein the fan is configured to generate a negative air pressure within the drum.

* * * * *